US007117706B2

(12) United States Patent
Savoy

(10) Patent No.: US 7,117,706 B2
(45) Date of Patent: Oct. 10, 2006

(54) PROGRAMMABLE APPARATUS AND METHOD FOR BODY PANEL ATTACHMENT

(75) Inventor: Mark A. Savoy, Metamora, MI (US)

(73) Assignee: Utica Enterprises, Inc., Shelby Township, MI (US)

( * ) Notice: Subject to any disclaimer, the term of this patent is extended or adjusted under 35 U.S.C. 154(b) by 268 days.

(21) Appl. No.: 10/329,893

(22) Filed: Dec. 26, 2002

(65) Prior Publication Data

US 2004/0123714 A1 Jul. 1, 2004

(51) Int. Cl.
*B21D 28/34* (2006.01)

(52) U.S. Cl. ..... 72/334; 72/447; 83/688

(58) Field of Classification Search ..... 72/334, 72/447; 83/688, 689; 92/28, 29
See application file for complete search history.

(56) References Cited

U.S. PATENT DOCUMENTS 237,439 A * 2/1881 Jenkins ..... 83/688
2,522,440 A * 9/1950 Freter ..... 72/464
3,777,601 A * 12/1973 Strandell ..... 83/160
4,760,633 A * 8/1988 Dacey, Jr. ..... 29/432.1
4,981,069 A * 1/1991 Matsui ..... 92/28
5,279,197 A * 1/1994 Takeda et al. ..... 83/631
5,440,912 A * 8/1995 Copeman ..... 72/334

* cited by examiner

*Primary Examiner*—Lowell A. Larson
(74) *Attorney, Agent, or Firm*—VanOphem & VanOphem, P.C.

(57) ABSTRACT

A method and apparatus for forming attachment pads in an inner body panel for the precise attachment of an outer body panel thereto. The apparatus positions a fixed anvil at a predefined net reference position while a face plate simultaneously "finds" the panel and is mechanically locked into position. Thereafter, the apparatus forms the inner body panel between a forming die and the fixed anvil. The face plate maintains the location of the surface metal around the die, resulting in the formation of a raised pad the outermost surface of which is at the predefined net reference position. A single such apparatus can form raised pads having different predefined net reference positions for different attachment locations. A reciprocating punch having a variable stroke length selectively provides either a hole or a slot in the raised pad.

27 Claims, 12 Drawing Sheets

PROGRAMMABLE APPARATUS AND METHOD FOR BODY PANEL ATTACHMENT

CROSS-REFERENCES TO RELATED APPLICATIONS

Not applicable.

FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

This invention relates to the precise attachment of a first member to a second member, and provides a method of and apparatus for reforming the second member by a variable magnitude depending on the actual position of the second member relative to a predefined net reference position. The invention relates, in particular, to the precise attachment of an outer body panel member of an automotive vehicle to an imprecisely located element of an inner body panel structure.

2. Description of the Related Art

In the automotive industry, the assembly of vehicles involves the attachment of outer body panels to inner body panels or body structures. It is therefore important that the inner body panel attachment positions be precisely located with respect to predetermined three-dimensional coordinates so that variations thereof are not translated through the attachment of the outer body panels so as to be visible to the customer.

W. S. Zaydel, et al., U.S. Pat. No. 4,438,971, describes a method of and apparatus for attaching, at a precise location, a plastic automotive body panel to a relatively imprecisely located element of an inner body panel structure. According to the teachings of this patent, plastic-filled metal attachment blocks or pads are welded at selected locations to the inner body panel structure. The inner body panel structure is then positioned within a locating and machining fixture and each of the plastic-filled attachment blocks is milled to a precise position, the distance between the inner body panel structure and the milled face of the plastic-filled attachment blocks varying with the position of the inner body panel structure. The plastic outer body panel member is then attached to the milled face of the plastic-filled attachment block, after drilling a hole in the plastic-filled attachment block to receive a threaded fastener or a fastener attached to the inside of the plastic outer body panel member. By this method and apparatus, each such plastic outer body panel member is mounted in a precisely determined and in precise surface alignment with each adjacent plastic panel.

The method and apparatus of the aforesaid U.S. Pat. No. 4,438,971 does lead to precision in the positioning of plastic outer body panels to a relatively imprecisely positioned automotive inner body panel structure, but it requires the attachment of the plastic-filled attachment blocks to the inner body panel structure which adds to the material and processing costs. Additionally, the subsequent milling of the plastic-filled attachment blocks generates scrap which is a mixture of a metal and the plastic filler material which, for the disposition of such scrap in an environmentally acceptable manner, involves additional expense and, in any case, the milling of the plastic-filled attachment blocks generates dust corresponding, mainly, to the composition of the plastic filler. This is also objectionable on environmental and workplace health and safety grounds, unless strict precautions are followed in performing the milling and drilling of the plastic-filled attachment blocks.

It is also known in the prior art that a relatively imprecisely located automotive inner body panel element can be built up to provide for the attachment thereto of an outer body panel element at a more precisely determined location by attaching one or more metal shims to the surface of the inner body panel element to which the outer body element is to be attached, the number of such shims to be attached based on the original position of the inner body panel element. However, this is a time-consuming and expensive procedure, and the attachment of such shims adds to the weight of the vehicle, an undesirable feature especially since it detracts from fuel economy.

Dacey, Jr., U.S. Pat. Nos. 4,760,633 and 4,884,431 disclose a method and apparatus for body panel attachment which reforms a portion of an inner panel member to a precise location. This method and apparatus employs an anvil that is moved into a known position defining the desired precise location of the inner panel attachment surface. Floating support members engage and thereby locate the inner panel, and are then locked in a fixed position.

A hydraulic ram is actuated and moves a pad forming member mounted thereon under force against the inner panel to deform a portion of the inner panel between the floating support members into engagement with the anvil. This results in an attachment pad being formed in the inner panel whose surface is located at the precise location desired for attachment to another member, such as an outer body panel. While the pad forming member is still in engagement with the anvil, a punching operation is performed to form an aperture in the pad. A punch is moved by a separate hydraulic cylinder through the pad to form the aperture.

While Dacey, Jr. does provide an alternate method for precisely assembling an outer body panel to an imprecisely located inner body panel, both patents rely on hydraulic actuation of the ram and punch. Hydraulic equipment generally suffers from the disadvantages of significantly increased cost and maintenance requirements, slow operation, and auxiliary cooling requirements. Additionally, hydraulic devices include a pressurized fluid, typically oil, that occasionally leaks as a result of long term use within the environment of an assembly operation. Hydraulic leaks are messy, carcinogenic, environmentally unacceptable, and present a serious fire hazard. Finally, the heating and consequent expansion of the hydraulic fluid must be taken into consideration for precise control of variable speed and/or variable stroke hydraulic ram devices.

Jackson, U.S. Pat. No. 5,133,206 discloses a method and apparatus for forming a portion of a panel member to a predetermined reference position. The apparatus includes a sensing device that locates the actual position of a panel member. Next, an extendible and retractable rod positions a holding means including a first and second pair of arms at the actual located position of the panel member established by the sensing device. A drive means is then actuated to move the first and second pair of arms into engagement with the panel member to hold adjacent sides of the portion of the panel member to be reformed to the predetermined reference position.

After locating and holding the panel member, a forming means including a fourth pair of arms is moved to urge a forming member into the panel member to reform the portion of the panel member to the predetermined reference position. An aperture is optionally pierced in the reformed portion of the panel member by sequentially urging a piercing pin mounted on the end of a third pair of arms into the reformed portion of the panel member.

The invention disclosed by Jackson also includes the steps of camming the first and second pair of arms between the first and second positions, as well as camming the third and fourth pair of arms from a first position spaced from the panel member to a second position such that the forming member and piercing pin engage the panel member. The step of camming the holding means from the first to the second positions is initiated before the step of camming the forming means is initiated so as to bring the holding means into engagement with the panel member before the forming means engages the panel member.

The Jackson invention identifies the same problem addressed by Dacey, Jr., and teaches an apparatus adapted to provide the same solution taught by Dacey, Jr. Although Jackson alleges an improved apparatus, the only support provided for such allegation is that the apparatus employs a single actuation device for holding the inner body panel in a fixed position. The Jackson invention, however, remains problematic for the following reasons.

The apparatus taught by Jackson is excessively complex and thus unnecessarily expensive and subject to failure. More specifically, Jackson incorporates numerous moving components including a positioning means having an extendible and retractable rod, a hydraulic or pneumatic drive means responsive to the output of a sensor device, and four pair of adjustable arms each having a cam device wherein each moving component gives rise to an additional mode of failure.

Furthermore, Jackson discloses a complex sensor device adapted to locate the panel member and transmit a corresponding output signal to the drive means that is controlled thereby. This sensor device is a critical feature of the disclosure whereby any imprecision thereof is proportionally translated to the attachment pad formed on the inner body panel, and potentially gives rise to a visibly misaligned outer body panel. As the effectiveness of the Jackson apparatus is predicated on the sensor device maintaining a high degree of precision over numerous cycles, the device becomes increasingly expensive. Finally, Jackson does not disclose a device for analyzing the precision of the sensor device for purposes of error proofing, whereby loss of precision thereof will likely result in numerous defectively assembled automobiles before it can be identified and addressed.

Copeman, U.S. Pat. No. 5,440,912 discloses an apparatus adapted to form a workpiece to a net position and pierce a hole in the workpiece. The apparatus generally includes an inner and an outer slide assembly. The outer slide assembly includes a hydraulic form cylinder slidably mounted to a base, the form cylinder has a form punch mounted thereon via a pair of outer slide rails. The inner slide assembly includes a hydraulic pierce cylinder, including a form back-up and is coupled to a form cylinder rod end via a cylinder mounting block extension.

The workpiece is positioned between the form back-up of the inner slide assembly and the form punch of the outer slide assembly. Actuation of the form cylinder compels the cylinder mounting block extension along with the entire inner slide assembly toward the workpiece until the form back-up contacts the workpiece. A slave cylinder connected to the inner slide assembly is fillable through a one way valve so that when the form back-up of the inner slide assembly contacts the workpiece, the slave cylinder locks the form back-up in place.

The form cylinder continues to push the form cylinder rod end thereby moving a form punch and an anvil, connected via the outer slide rails, toward the workpiece. The form cylinder extends a predetermined amount to emboss the workpiece to a net position. After the workpiece has been embossed, a pierce cylinder of the inner slide assembly actuates a punch to pierce a hole in the workpiece. The use of hydraulic cylinders by Copeman present the same disadvantages for this device as set forth with regard to the device of Dacey, Jr.

The inventions of Dacey, Jr., Jackson and Copeman disclose similar devices. Jackson claims to require fewer steps than Dacey, Jr., and Copeman claims to be more compact, however, the devices accomplish the same objective in much the same way. One of the common features of Dacey, Jr., Jackson and Copeman includes an actuation device having constant velocity and stroke. More sophisticated programmable punching and forming motions including variable velocity and stroke are advantageous for a number of reasons described in detail hereinafter.

Variable velocity punching and forming devices reduce cycle time by varying the speed of the ram over the cycle with a rapid ram advance and retraction combined with slower speeds as the work piece is approached as well as during actual punching or forming. Variable velocity allows for a broader working range in that a single actuation device can accommodate a variety of different size dies and/or punches, and can form and/or punch a variety of different materials and material configurations.

Variable stroke forming devices permit positive depth control of a formed feature. Variable stroke punching devices are capable of making a variety of different sized and shaped holes with a single cutting tool. This is accomplished by, for example, providing a cutting tool having an initial cutting surface and a secondary cutting surface a predetermined axial distance therefrom, wherein the effective diameter of the secondary engagement surface is necessarily larger than that of the initial engagement surface. A variable stroke device incorporating such a cutting tool can form a small hole using a short stroke such that the secondary cutting surface does not contact the material to be punched. The same device can also form a larger hole by using a longer stroke such that both the initial and secondary cutting surfaces pass through the material to be punched.

Finally, an apparatus having a programmable punching motion in combination with a linear transducer provides automatic error proofing of the process to ensure that a hole has been punched. As is well known in the art, the current signature provided by the linear transducer is representative of punch/metal resistance, as the resistance encountered by the punch greatly increases during engagement with the metal panel, a current spike is generated. Accordingly, a current spike indicates a successful punching operation, and conversely the absence of a current spike indicates the desired punching operation was not performed (i.e. the punch broke and did not engage the panel).

From the above, it can be appreciated that the prior art methods and apparatuses for precisely positioning and attaching a first member to an imprecisely located second member by forming a portion of the second member to a predetermined net reference position are not fully optimized. Therefore, what is needed is a punching and forming apparatus having variable velocity and stroke, which does not rely on hydraulic actuation, that is simple, reliable and inexpensive as well as environmentally acceptable.

BRIEF SUMMARY OF THE INVENTION

According to the preferred embodiment of the present invention, there is provided a method of and apparatus for programmably reforming a work piece by a variable amount to present its surface or one or more selected portions thereof at a precise position for the attachment of a complementary member thereto. The method and apparatus are particularly adapted for reforming a portion of an inner automotive body panel to receive an outer automotive body panel at a location that is more precisely determined than the original location of such inner automotive body panel.

A single such apparatus may be configured to form one or more attachment pads at specific locations on the work piece, such that the external surface of each attachment pad is precisely located at a predefined net reference position regardless of the initial position of the work piece within an acceptable tolerance range, and thereafter optionally punch a hole or slot in each attachment pad. The predefined net reference position for each specific location is maintained at a fixed position from vehicle to vehicle. However, a person skilled in the art recognizes that this fixed position may vary from one location to another due to the variable contours of the complementary members being attached to the work piece.

The apparatus of the present invention includes a punch disposed within a hollow portion of a fixed anvil that is in turn circumscribed by a face plate passage such that the punch, the hollow portion of the fixed anvil, and the face plate passage are coaxially aligned. The punch has a primary cutting surface at an end portion thereof and a secondary cutting surface located a predetermined axial distance therefrom, the contour of the secondary cutting surface encompassing that of the primary cutting surface. The fixed anvil has a pad contacting surface that provides a fixed net stop to locate and support the external surface of the attachment pad during the formation thereof. The face plate includes a support surface and a passage therethrough. The punch is translatable through the hollow portion of the fixed anvil, in a direction toward or away from the engaged portion of the work piece. The face plate is biased in a direction away from the fixed anvil to locate against the inner body panel and be slidably retracted by contact with the inner body panel while the fixed anvil is moved to the predefined net reference position for a specific location.

The face plate is biased in a fully extended position such that the support surface protrudes axially beyond the pad contacting surface of the fixed anvil. The pad contacting surface is initially positioned apart from the work piece by an amount sufficient to ensure that support surface of the face plate does not prematurely engage the work piece. Thereafter, the apparatus of the present invention is moved along the axis of the fixed anvil toward the work piece in a direction generally perpendicular thereto. As the pad contacting surface approaches the predefined net reference position for a specific location, the support surface of the fully extended face plate comes into contact with the work piece. Additional advancement of the pad contacting surface toward the predefined net reference position overcomes the fully extended bias of the face plate, which effectively retracts the support surface of the face plate relative to the pad contacting surface of the fixed anvil.

The apparatus of the present invention "finds" the work piece by positioning all three axes of the pad contacting surface of the fixed anvil at the predefined net reference position for the specific location, such that the axial distance between the support surface and the pad contacting surface is representative of the difference between the original position of the work piece and the precisely located predefined net reference position therefor. After positioning the fixed anvil at the predefined net reference position for a specific work piece location, the face plate is pneumatically locked into position such that the support surface of the face plate remains in contact with the work piece. The pneumatically actuated locking mechanism advantageously replaces conventional hydraulically actuated devices thereby avoiding the associated disadvantages described hereinabove.

The apparatus of the present invention further includes a form ram that is preferably driven by a ball screw device and a reversible electric servo-motor such that the velocity, acceleration and stroke length of the ram are programmable. Additionally, electric actuation of the ram avoids the disadvantages associated with similar hydraulic actuation described hereinabove. A forming die with a hollow central portion is mounted to the form ram whereby actuation of the form ram forms the work piece between the forming die and the pad contacting surface of the fixed anvil. The support surface of the face plate maintains the location of the surface metal around the forming die which results in the formation of a raised pad.

Accordingly, as long as the work piece is initially within an acceptable tolerance range, it will be provided with an attachment pad having an external surface precisely located at the predefined net reference position. The depth of each such pad varies according to the difference between the predefined net reference position for a specific location and the initial position of the work piece at the specific location. Each pad formed according to the method of the present invention is ready for the attachment of a complementary member thereto without any further processing or final hand fitting being required to establish its final attachment location.

The apparatus of the present invention is optionally adapted to provide a hole or contoured slot in the formed pad to receive a fastener and thereby facilitate attachment of a complementary member thereto. For this purpose, a second ball screw device and servo-motor similar to that disclosed hereinabove is provided to actuate the punch. While the forming die is still engaged with and thereby supporting an internal surface of the attachment pad, the punch advances through the work piece and into the hollow central portion of the forming die. A hole may be formed by limiting the stroke length of the punch such that only the primary cutting surface engages the work piece, whereas extending the stroke length so that both the primary and secondary cutting surfaces pass through the work piece provides a contoured slot.

Finally, as is well known in the art, the programmable punching motion disclosed herein provides automatic error proofing to ensure that indeed a hole was punched. A current signature generated by the programmable punch is representative of resistance, and as the resistance encountered by the punch greatly increases during engagement with the work piece, a current spike is produced. Accordingly, a current spike indicates a successful punching operation, and conversely the absence of a current spike indicates the desired punching operation was not properly performed (i.e. the punch broke and did not engage the work piece).

Therefore, it is an object of the present invention to provide a method and apparatus for precisely positioning and attaching a first member to an imprecisely located second member, wherein the apparatus includes a punching and forming device having variable velocity and stroke.

It is another object to provide a method and apparatus for precisely positioning and attaching a first member to an imprecisely located second member, wherein the apparatus is not hydraulically actuated and therefore not subject to the associated disadvantages disclosed hereinabove.

It is still another object to provide a simple, reliable and inexpensive method and apparatus for precisely positioning and attaching a first member to an imprecisely located second member.

It is yet another object to provide a method and apparatus for forming a portion of a panel member to a predefined net reference position having a reduced cycle time.

It is a further object to provide an apparatus for forming a portion of a panel member to a predefined net reference position and punching a hole in the formed portion of the panel member, wherein the apparatus has a broad working range in that a single actuation device can accommodate different size forming dies and punches, and can form or punch a variety of different materials and material configurations.

It is still a further object to provide an apparatus capable of making a variety of different sized and shaped holes with a single cutting tool.

It is yet a further object to provide a method and apparatus for error proofing a punching operation whereby it will be made readily apparent if and when the punching operation is unsuccessful.

It is still yet a further object to provide an apparatus for pneumatically actuating and maintaining the internal locking mechanism of a work support device.

It is another object to eliminate the expense associated with hydraulics in an automotive work environment.

It is another object to eliminate environmental and safety hazards associated with hydraulic oil in an automotive work environment.

It is another object to provide a method and apparatus for net attaching components such as tail lamps, bumpers, fascias, head lamps, fuel filler doors, etc.

These objects and other features, aspects, and advantages of this invention will be more apparent after a reading of the following detailed description, appended claims, and accompanying drawings.

DETAILED DESCRIPTION OF THE PREFERRED EMBODIMENT

Figure 1:
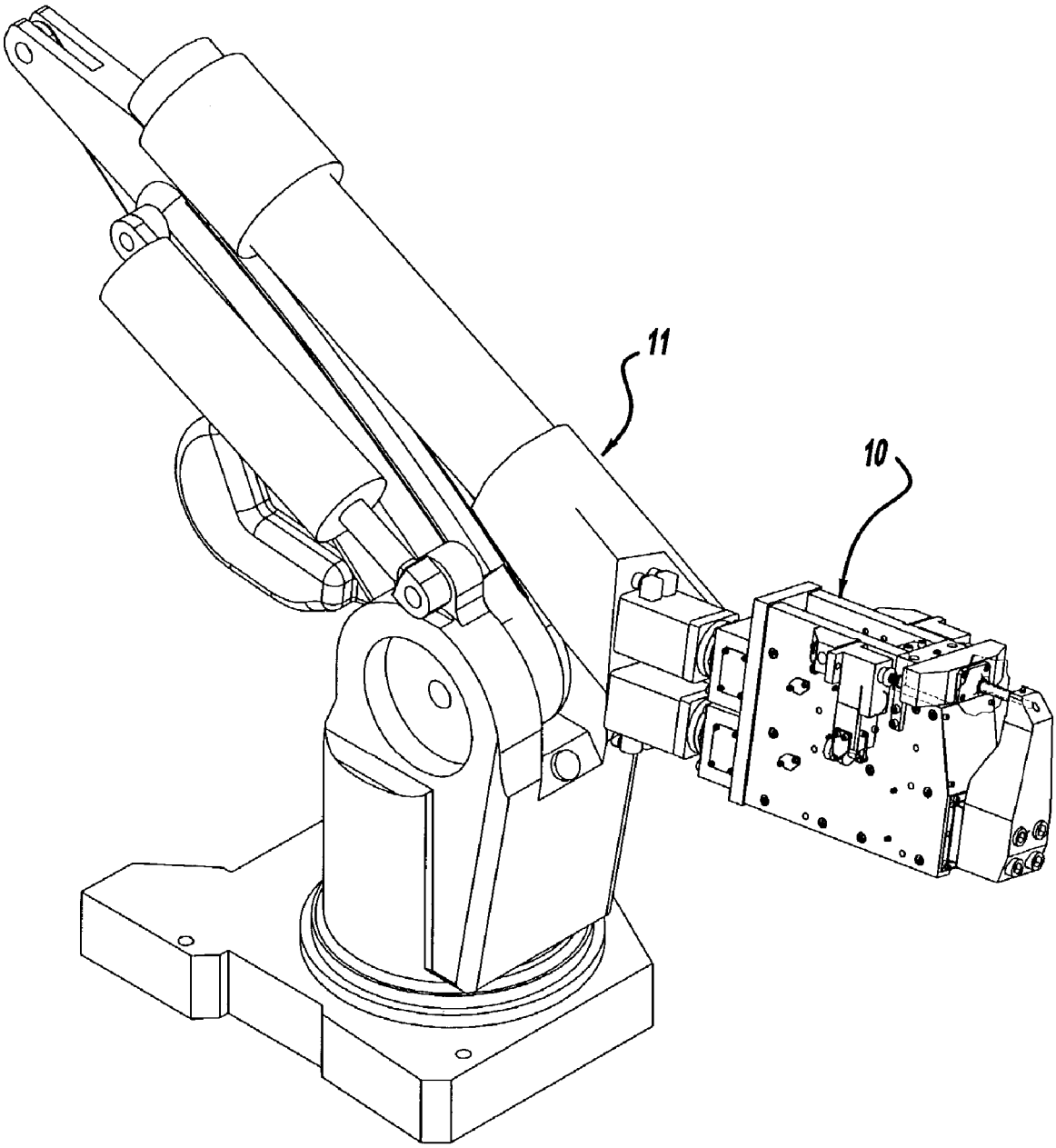
FIG. 1 is a side view of a preferred embodiment of the apparatus according to the present invention shown attached to a robot.
Figure 2:
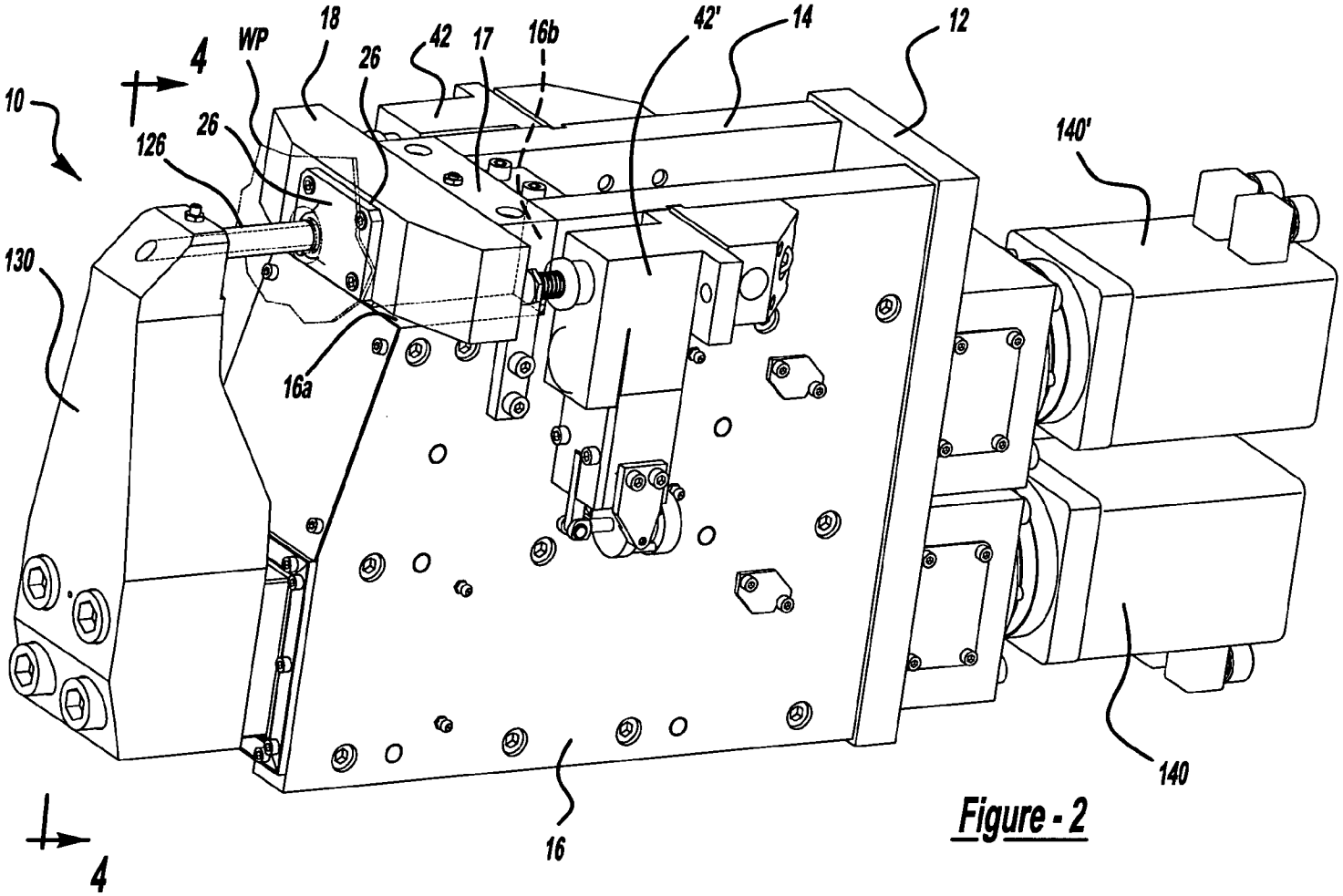
FIG. 2 is an isometric view of the apparatus of FIG. 1.
Figure 7:
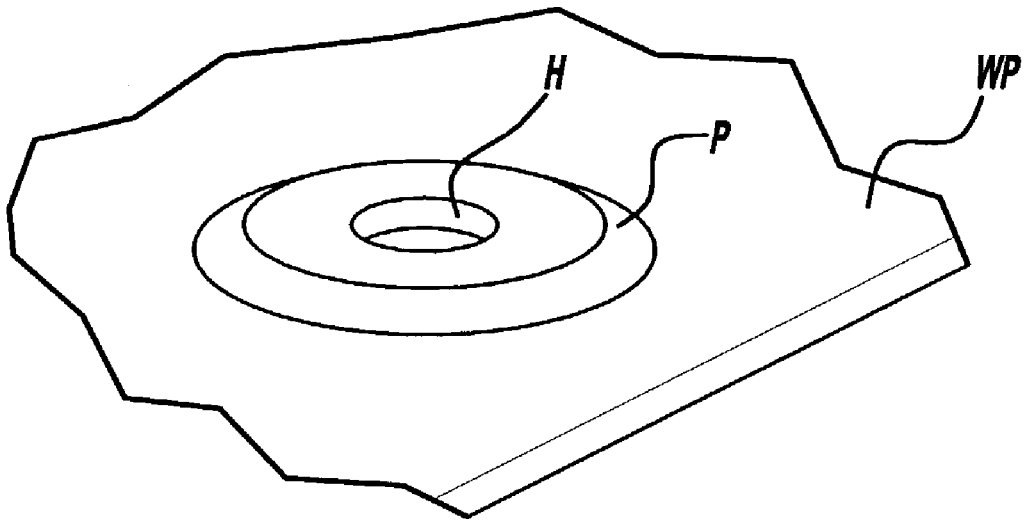
FIG. 7 is a partial isometric view showing an inner body panel formed and punched by the apparatus of FIG. 2 according to the method of FIGS. 6*a*–6*e;*

Referring now in detail to the Figures, there is shown in FIGS. 1 and 2 a net locating device in the form of a pad forming device 10 that is constructed in accordance with the present invention. According to the preferred embodiment, one or more programmable robots 11 move the pad forming device 10 into and out of working engagement with a work piece WP, and precisely position the pad forming device 10 relative to specific locations on the work piece WP. The pad forming device 10 is adapted to form an attachment pad P (shown in FIG. 7) at one or more specific locations on the work piece WP, such that the external surface of each attachment pad P is precisely located at a predefined net reference position independently defined for each location, and thereafter punch either a hole H (shown in FIG. 7) or slot (not shown) in the attachment pad P. As long as the work piece WP is within an acceptable tolerance range, it is provided with an attachment pad P having an external surface precisely located at the predefined net reference position, and a complementary member is attachable thereto without any further processing or adjustments.

In the context of the following detailed description of the preferred embodiment, the work piece WP should be considered to represent an inner automotive body panel, however it should be appreciated that the work piece WP is intended to encompass other structural elements in other environments as well. Furthermore, although the preferred embodiment disclosed herein refers to the net attachment of an outer automotive body panel, the invention is equally adapted for the net attachment of other components such as tail lamps, bumpers, fascias, head lamps, fuel filler doors, etc. Finally, relative terms such as front, rear, top, bottom, etc. apply to the pad forming device 10 as viewed in FIG. 2, wherein a die block 130 defines the front, and servomotors 140, 140' define the rear.

Figure 3:
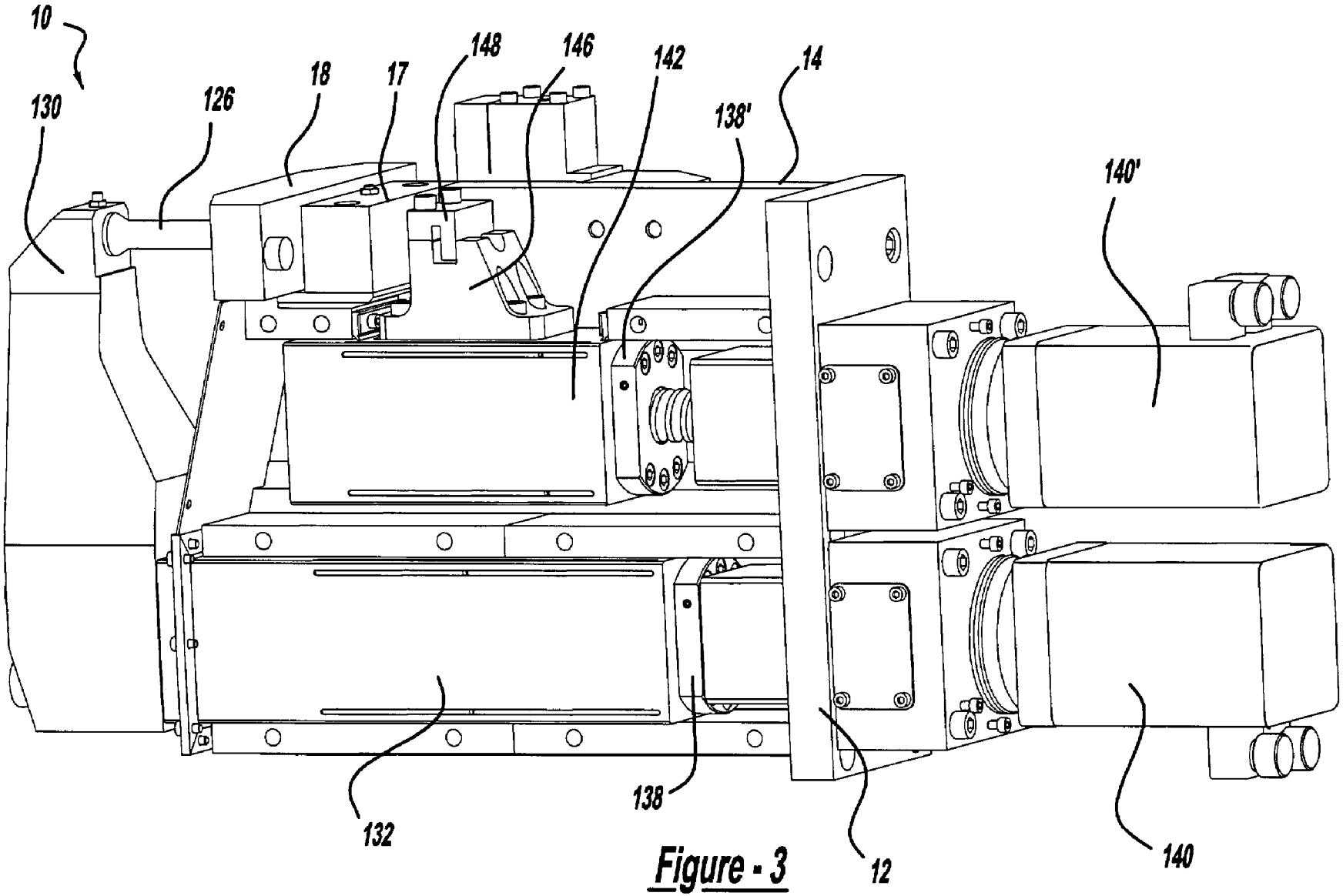
FIG. 3 is a cutaway side view of the apparatus of FIG. 2.
Figure 4:
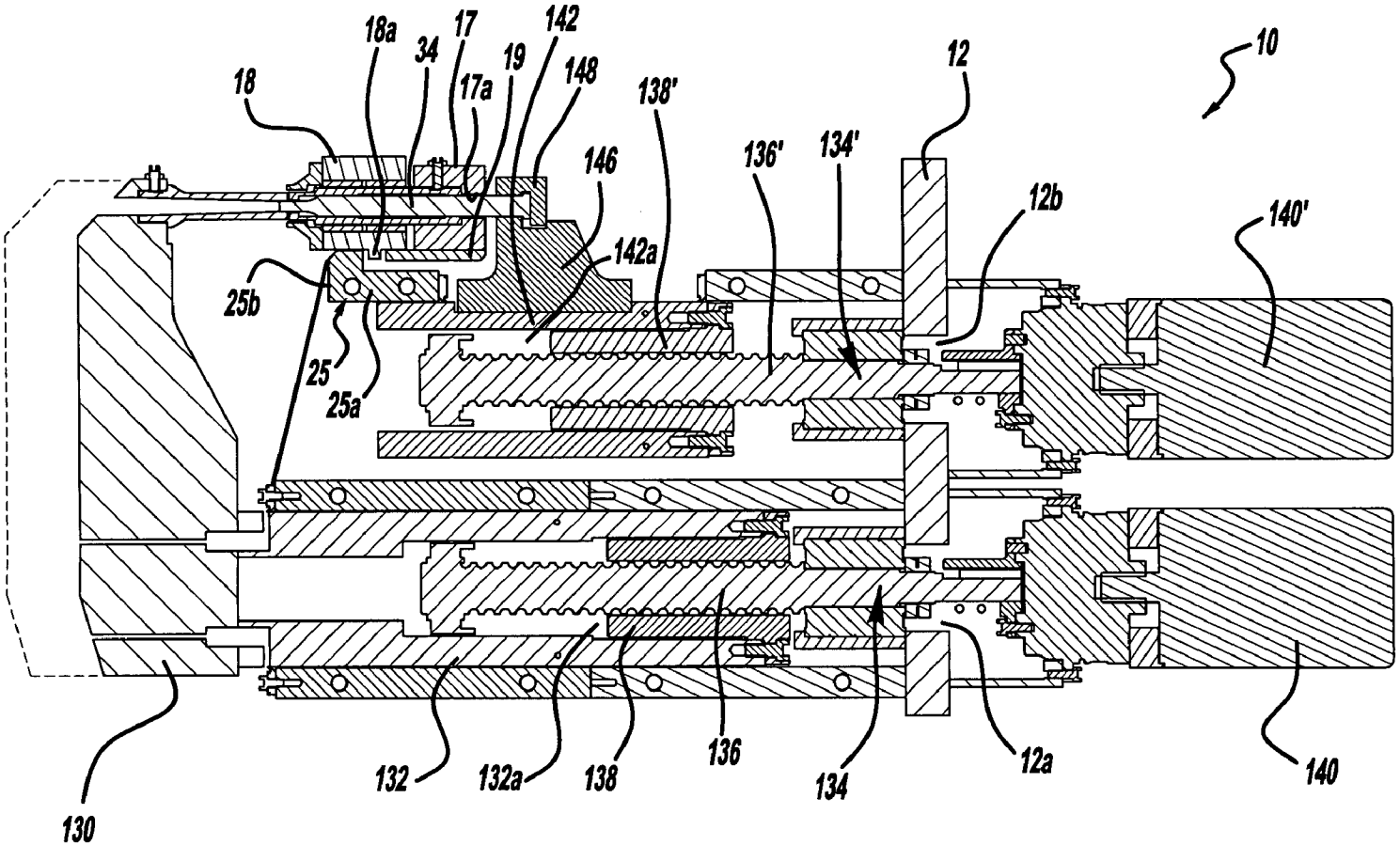
FIG. 4 is a section taken along line 4—4 of FIG. 2.

As shown in FIGS. 2–4, the pad forming device 10 includes a generally rectangular motor plate 12 having an aperture 12*a* disposed below an aperture 12*b*. The servomotors 140, 140' are respectively aligned with the apertures 12*a*, 12*b*, and thereafter mounted to the motor plate 12 as will be explained more fully hereinafter. The pad forming device 10 also includes spaced apart generally parallel side plates 14, 16 that are attached to the motor plate 12 opposite the servo-motors 140, 140', and extend therefrom in a forward direction. The side plates 14, 16 respectively have recessed portions 14*a* (not shown), 16*a*, defining shoulders 14*b* (not shown), 16*b* that are generally parallel to the motor plate 12. It should be appreciated that the side plates 14 and 16 are generally identical and while the recessed portion 14*a* and the shoulder 14*b* are not identified in the figures, they are similar to the recessed portion 16*a* and the shoulder 16*b*, respectively.

A retainer block 17, having a passage 17*a* extending therethrough in a fore/aft direction, mounts to the side plates 14, 16 such that the retainer block 17 is supported by shoulders 14*b*, 16*b* in a fore/aft direction, and is rigidly attached to the recessed portions 14*a*, 16*a* in an up/down direction. A spacer 19 adapted to provide for up/down adjustment of the retainer block 17 is disposed between the retainer block 17 and the recessed portions 14*a*, 16*a*, and extends in a forward direction beyond the retainer block 17. As is well known in the art, the spacer 19 is initially oversized in the up/down direction, and correspondingly the retainer block 17 is initially at the upper end of adjustment, thereafter the spacer 19 is ground by an amount necessary to lower the retainer block 17 to an aligned up/down position therefor.

Figure 5:
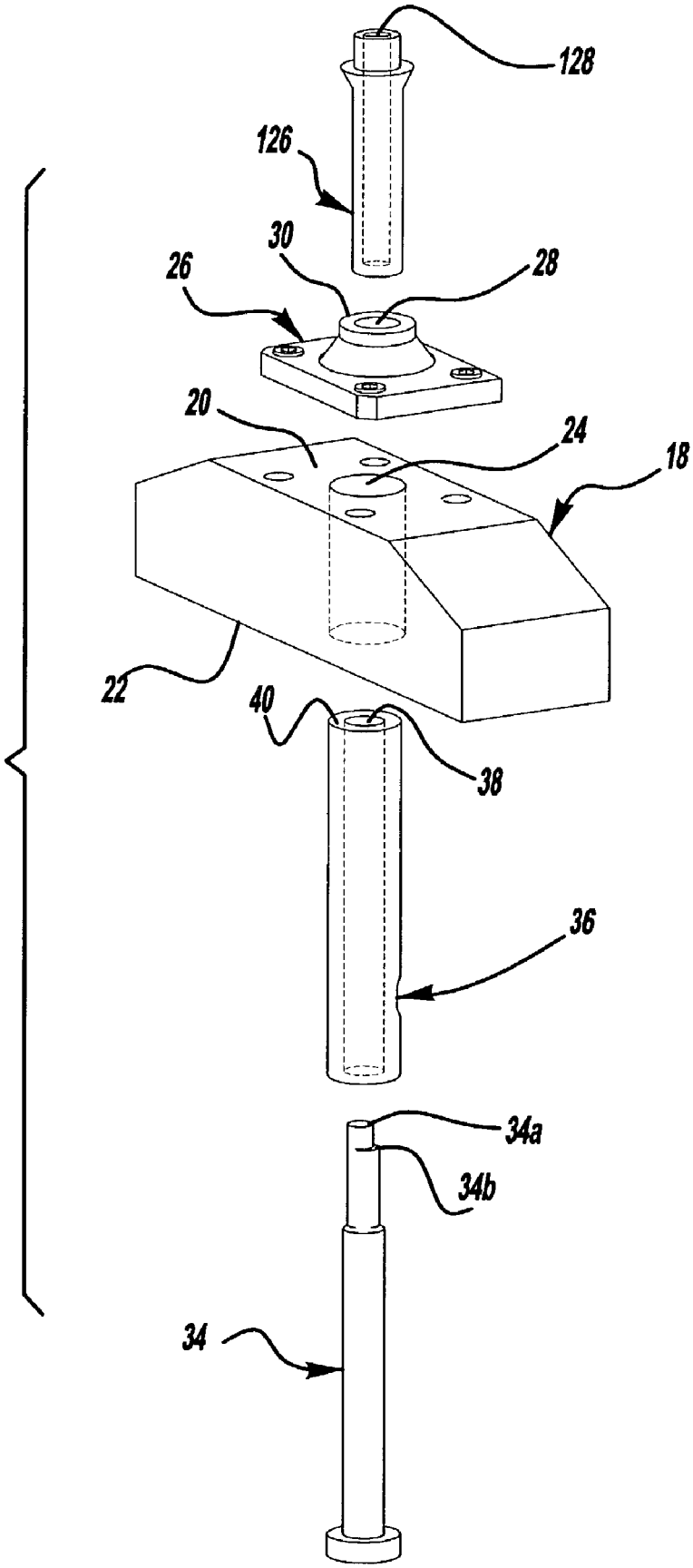
FIG. 5 is an exploded view showing details of the punching and forming components of the apparatus of FIG. 2.

An L-shaped spacer 25 having a leg portion 25*a* and a foot portion 25*b* is disposed between the side plates 14, 16 and attached thereto such that the leg portion 25*a* is located below the recessed portions 14*a*, 16*a* and the foot portion 25*b* extends above the recessed portions 14*a*, 16*a* of the side plates 14, 16. Referring now to FIGS. 4 and 5, a slide block 18, having a front surface 20, a rear surface 22, and a passage 24 therethrough, is positioned in front of the retainer block 17 such that the passage 17*a* is aligned with the passage 24. The slide block 18 is adapted to translate in a fore/aft direction, is piloted about a fixed anvil 36 extending through the passage 24, and is engaged by an uppermost surface of the foot portion 25*b* which is configured to guide the slide block 18 and prevent rotation thereof. The up/down position of the slide block 18 may be adjusted in a manner similar to that of the retainer block 17 disclosed hereinabove, which specifically involves grinding the foot portion 25*b* of the L-shaped spacer 25 by an amount necessary to lower the slide block 18 to an aligned up/down position therefor. The slide block 18 includes a protrusion 18*a* extending therefrom in a downward direction adapted to limit the range of motion by engaging the foot portion 25*b* of the L-shaped spacer 25 at a forward end of travel and the spacer 19 at a rearward end of travel.

A face plate 26 having a support surface 30 and a passage 28 therethrough is mounted to the front surface 20 of the slide block 18 such that the passage 28 of the face plate 26 and the passage 24 of the slide block 18 are aligned. The fixed anvil 36 is disposed within the passage 17*a* of the retainer block 17 and rigidly attached thereto such that the fixed anvil 36 extends through the passage 24 of the slide block 18 and into the passage 28 of the face plate 26 terminating therein with a pad contacting surface 40. The pad contacting surface 40 of the fixed anvil 36 supports an external portion of the attachment pad P (shown in FIG. 7) during the formation thereof, and is therefore subjected to the resultant force generated during impact. It should be appreciated that the motor plate 12, the side plates 14, 16 and the retainer block 17 are configured to absorb such force acting on the pad contacting surface 40 of the fixed anvil 36 in a rearward direction. A punch 34 having a primary cutting surface 34*a* and a secondary cutting surface 34*b* is adapted to translate in a fore/aft direction through a hollow portion 38 of the fixed anvil 36, the passage 17*a* of the retainer block 17, the passage 24 of the slide block 18, and the passage 28 of the face plate 26.

Referring to FIGS. 6*a*–6*e*, the slide block 18 is biased in a fully extended position as will be described in detail hereinafter. Accordingly, the support surface 30 of the face plate 26 protrudes axially beyond the pad contacting surface 40 of the fixed anvil 36 by an amount equivalent to the maximum allowable pad depth for a particular application, and the L-shaped spacer 25 is engaged by the protrusion 18*a*. The robot 11 and associated programmable motion controls rapidly move the pad forming device 10 (shown in FIG. 1) into position with respect to the work piece WP resulting in the fixed anvil 36 being positioned in the vicinity of the work piece WP but at a known distance therefrom. The programmable motion control device then moves the pad forming device 10 into final position by moving the pad forming device 10 along the axis of the fixed anvil 36 in a direction generally perpendicular to the work piece WP such that the X, Y, and Z axes of the pad contacting surface 40 of the fixed anvil 36 are precisely positioned relative to the X, Y, and Z axes of a predefined net reference position for a specific location on the work piece WP where work is to be performed.

Figure 6A:
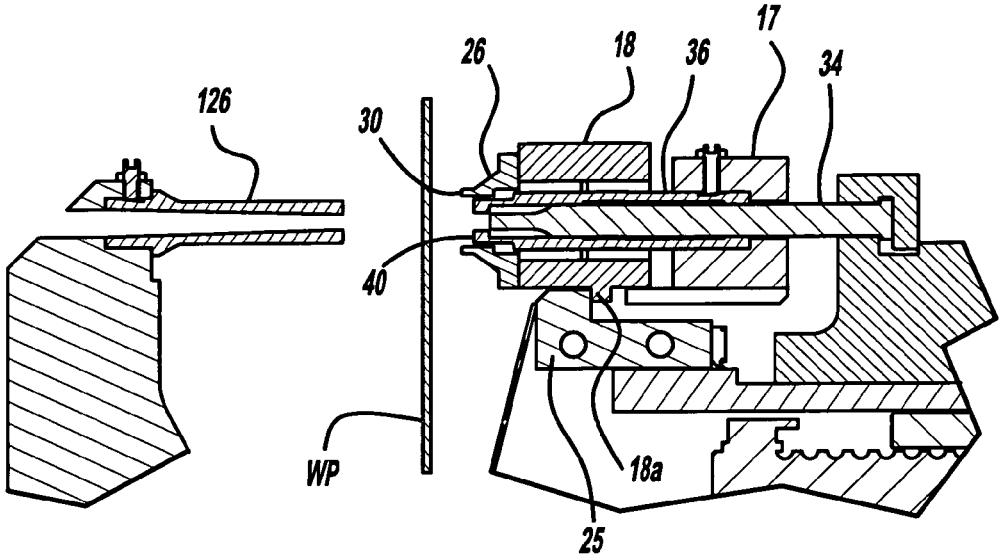
FIG. 6*a* is a fragmentary schematic view showing a step in the method of the present invention using the apparatus of FIG. 2.
Figure 6B:
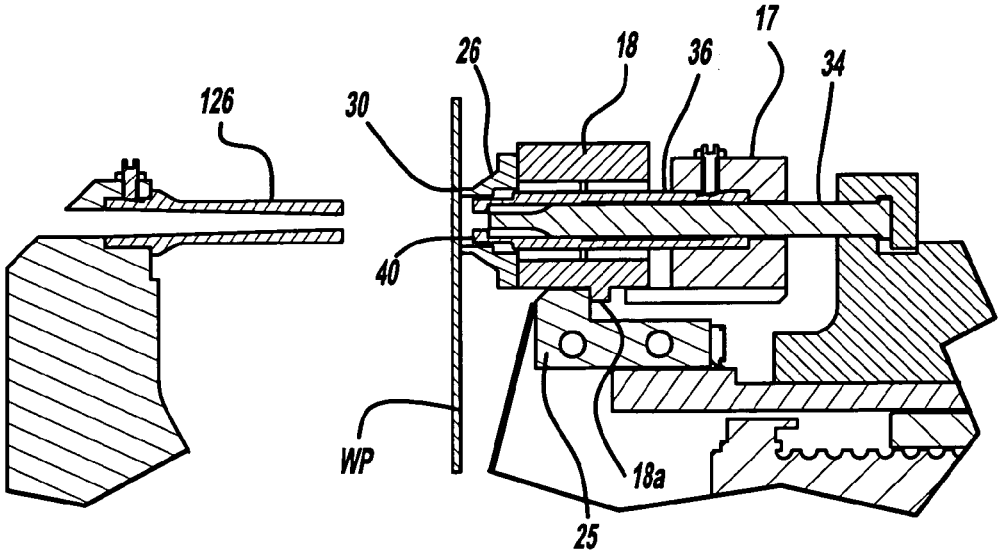
FIG. 6*b* is a view similar to FIG. 6*a* showing a subsequent step in the method of the present invention.

As seen in FIG. 6*a*, the pad contacting surface 40 is initially aligned with the predefined reference position and positioned apart from the work piece WP by an amount sufficient to ensure that support surface 30 of the face plate 26 does not prematurely engage the work piece WP. Thereafter, the robot 11 moves the pad forming device 10 (shown in FIG. 1) along the axis of the fixed anvil 36, toward the work piece WP in a direction generally perpendicular thereto, in order to bring the X, Y, and Z axes of the pad contacting surface 40 into alignment with the X, Y, and Z axes of the predefined net reference position. As the pad contacting surface 40 approaches the work piece WP, the fully extended support surface 30 of the face plate 26 comes into contact with the work piece WP (shown in FIG. 6*b*). Additional advancement of the pad contacting surface 40 toward the work piece WP overcomes the fully extended bias of the slide block 18, which effectively retracts the support surface 30 of the face plate 26 relative to the pad contacting surface 40 of the fixed anvil 36 until the fixed anvil 36 reaches the predefined net reference position.

Figure 6C:
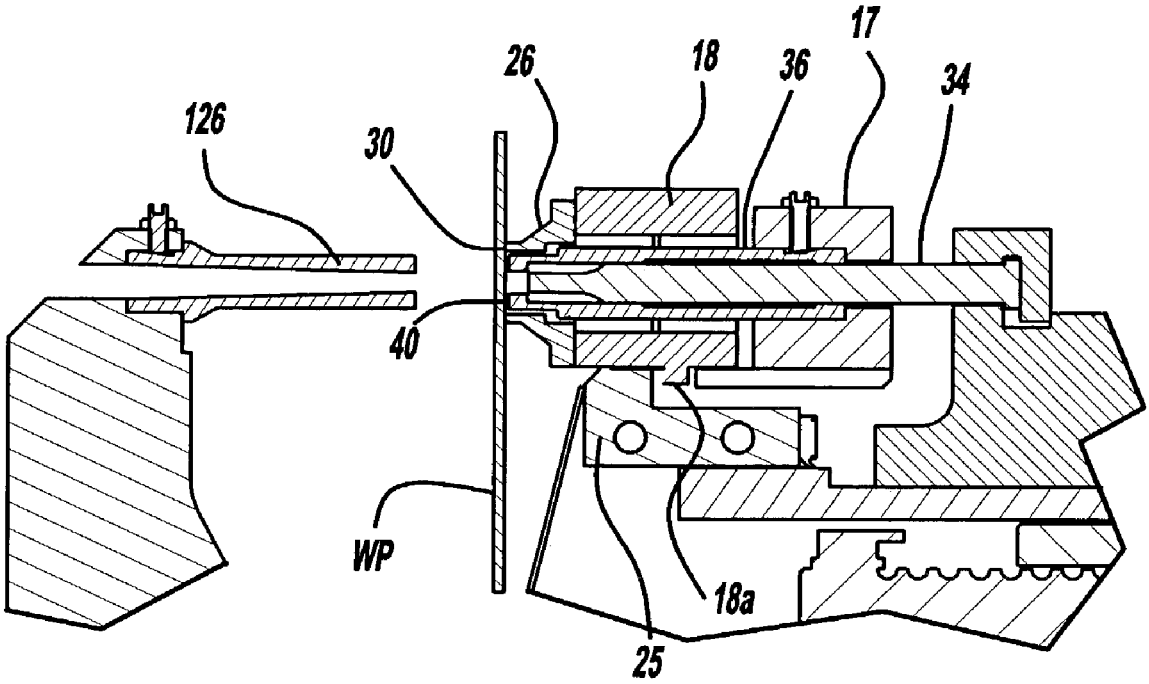
FIG. 6*c* is a view similar to FIGS. 6*a*–6*b* showing a subsequent step in the method of the present invention.

As seen in FIG. 6*c*, the pad forming device 10 "finds" the work piece WP by locating all three axes X, Y and Z of the pad contacting surface 40 at the predefined net reference position such that the axial distance between the support surface 30 and the pad contacting surface 40 is representative of the difference between the original imprecise position of the inner body panel attachment location and the precisely located predefined net reference position therefor. After "finding" the work piece WP, the slide block 18 is locked into a fixed position, as will be described in detail hereinafter, such that the support surface 30 of the face plate 26 remains in contact with the work piece WP. The pad forming device 10 is now in position to form the attachment pad P and punch the hole H.

Figure 6D:
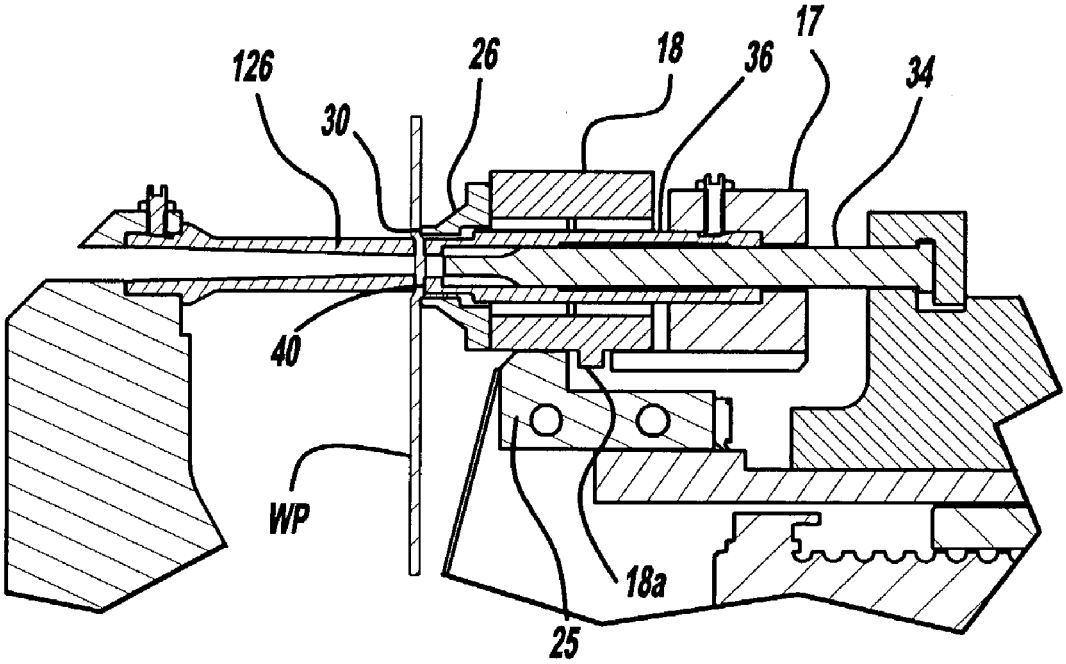
FIG. 6*d* is a view similar to FIGS. 6*a*–6*c* showing a subsequent step in the method of the present invention.
Figure 6E:
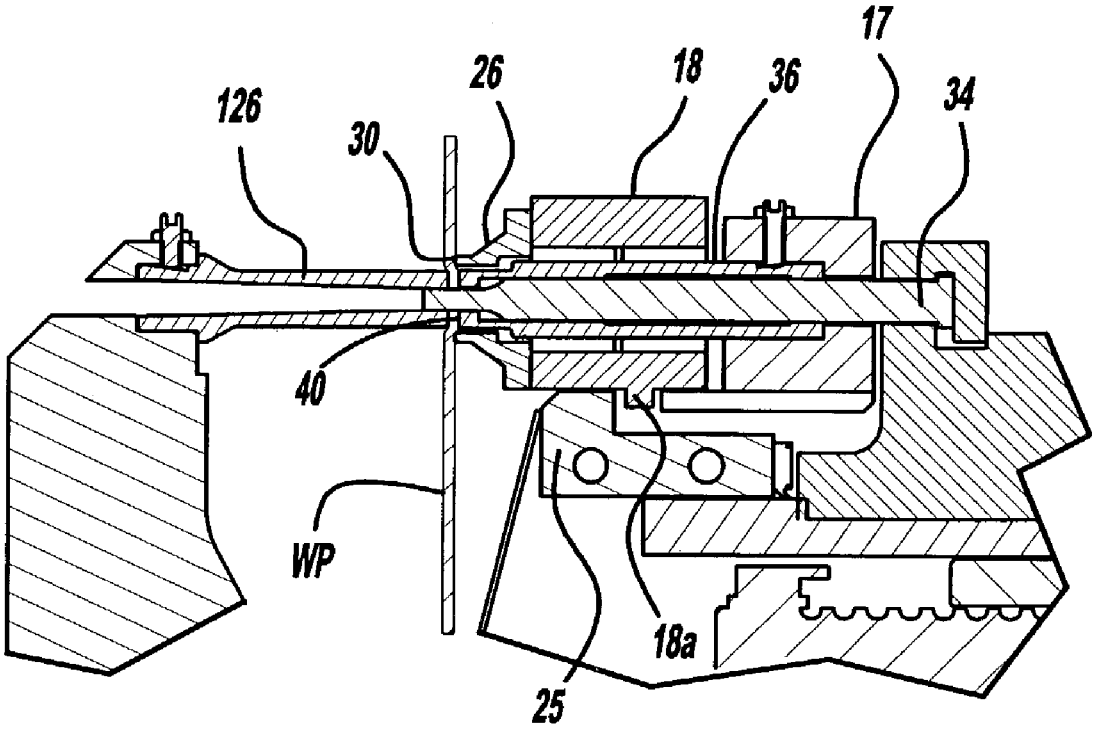
FIG. 6*e* is a view similar to FIGS. 6*a*–6*d* showing a subsequent step in the method of the present invention.

As shown in FIG. 6*d*, once the pad forming device 10 has "found" the work piece WP, and the slide block 18 has been locked in position, the portion of the work piece WP radially within the support surface 30 of the face plate 26 is deformed outwardly until it makes contact with the pad contacting surface 40 of the fixed anvil 36 to form the attachment pad P. As best seen in FIG. 5, this deforming is accomplished under a load that is imposed by a forming die 126 having a hollow central portion 128 therethrough. Referring to FIG. 6*e*, while the forming die 126 is in contact with the work piece WP, the punch 34 passes through the portion of the attachment pad P that is radially within and therefore unsupported by the forming die 126, and into the hollow central portion 128 thereof to punch the hole H.

Referring again to FIG. 2, reciprocation of the slide block 18 is actuated by first and second hydraulic work support devices 42, 42' of a known type, i.e. Hytec Hydraulic Work Support No. 100998 spring advance type work supports, attached to the first and second side plates 14, 16, respectively, in a conventional manner. U.S. Pat. No. 3,938,798 in the name of Solie et al. provides detailed disclosure pertaining to a similar work support device and accordingly is incorporated herein by reference in its entirety.

Figure 8A:
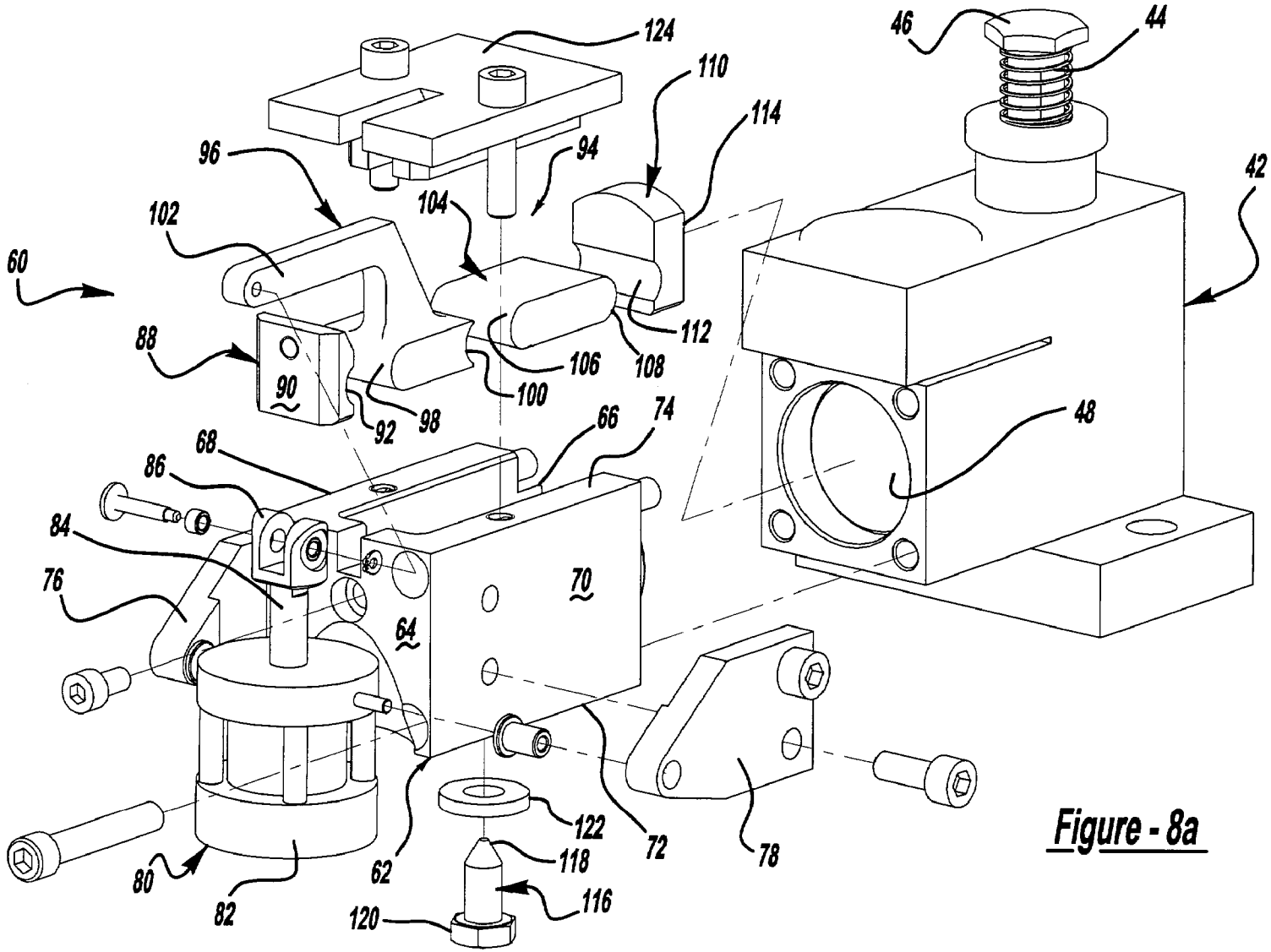
FIG. 8*a* is an exploded isometric view of a work support and pneumatic work support actuator of the apparatus shown in FIG. 2.
Figure 10:
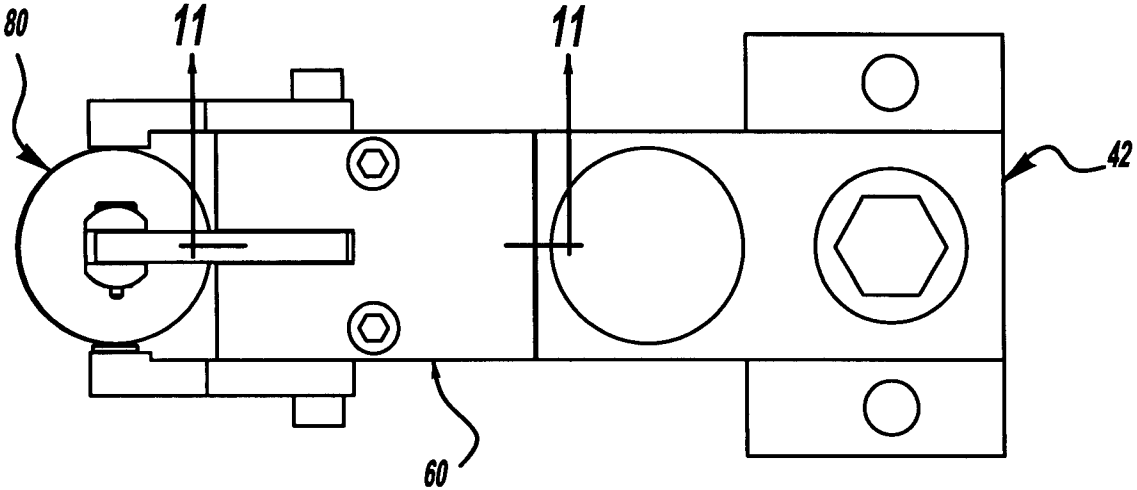
FIG. 10 is a plan view of the work support and pneumatic work support actuator shown in FIG. 8*a;*
Figure 9:
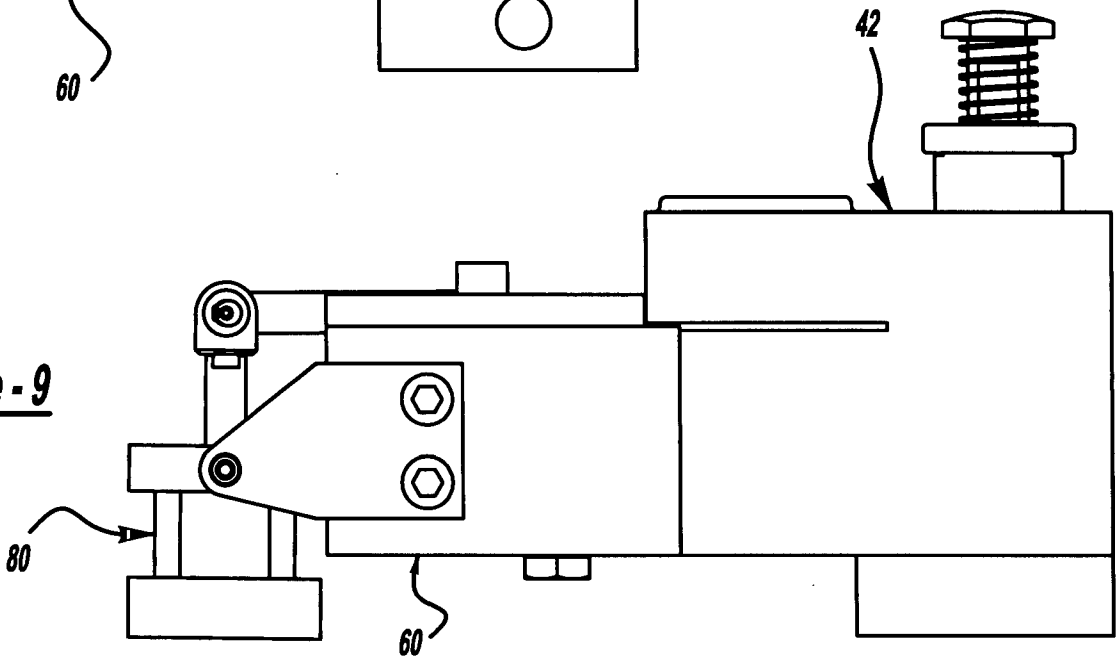
FIG. 9 is a side view of the work support and pneumatic work support actuator shown in FIG. 8*a;*

For purposes of clarity, only the composition and operation of the first work support device 42 will be disclosed, however it should be appreciated that the preferred embodiment of the pad forming device 10 includes a second identical work support device 42'. As shown in FIG. 8*a*, the work support device 42 includes a plunger or piston rod 44 displaceably mounted therein that terminates in a pad 46. The plunger 44 is normally biased to a fully extended position by an internal spring (not shown). The work support device 42 is adapted to lock the plunger 44 in place by contracting an internal sleeve or collet (not shown) to lockingly grip a circumferential portion (not shown) of the plunger 44 in its advanced position. Referring to FIGS. 9 and 10, the preferred embodiment of the present invention includes pneumatic work support actuators 60, 60' (not shown) adapted to pneumatically actuate the locking mechanism of the work support devices 42, 42' (not shown) such that hydraulic equipment is not required to operate the pad forming device 10.

Referring again to FIG. 8*a*, the internal sleeve (not shown) is contracted to lock the plunger 44 by applying force to a movable piston (not shown) within a cylinder 48 of the work support device 42. Although the force applied to the movable piston (not shown) is conventionally applied by hydraulic pressure, it should be appreciated that the work support locking mechanism may be actuated in response to a force applied by an alternate source adapted for such purpose as well. Additionally, it should be appreciated that while such actuation requires only a force of sufficient magnitude to overcome a nominal pre-load, the requisite magnitude for maintaining a work support in the locked condition is proportional to the pre-load in combination with any opposing force externally applied to the plunger 44. For this reason, work supports subjected to large external forces typically required hydraulic actuation as the compressibility of air renders pneumatic devices impractical.

Figure 8B:
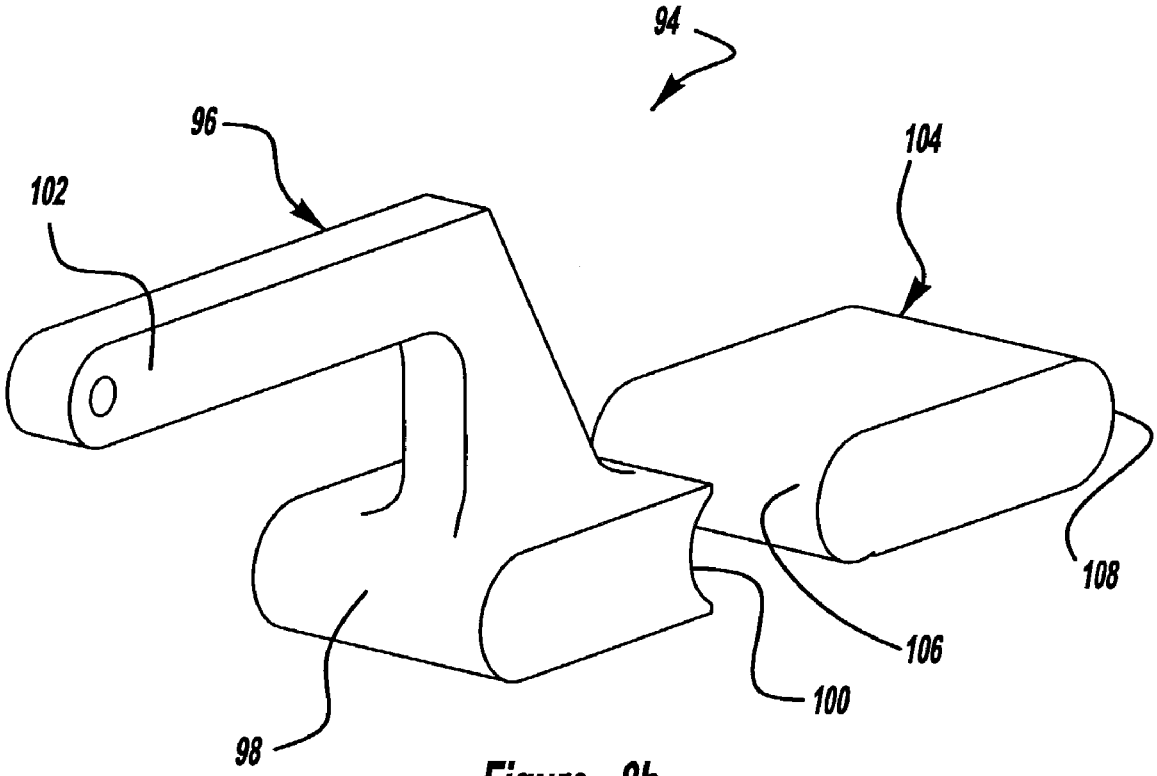
FIG. 8*b* is an isometric view of a toggle lock device of the pneumatic work support actuator shown in FIG. 8*a;*
Figure 8C:
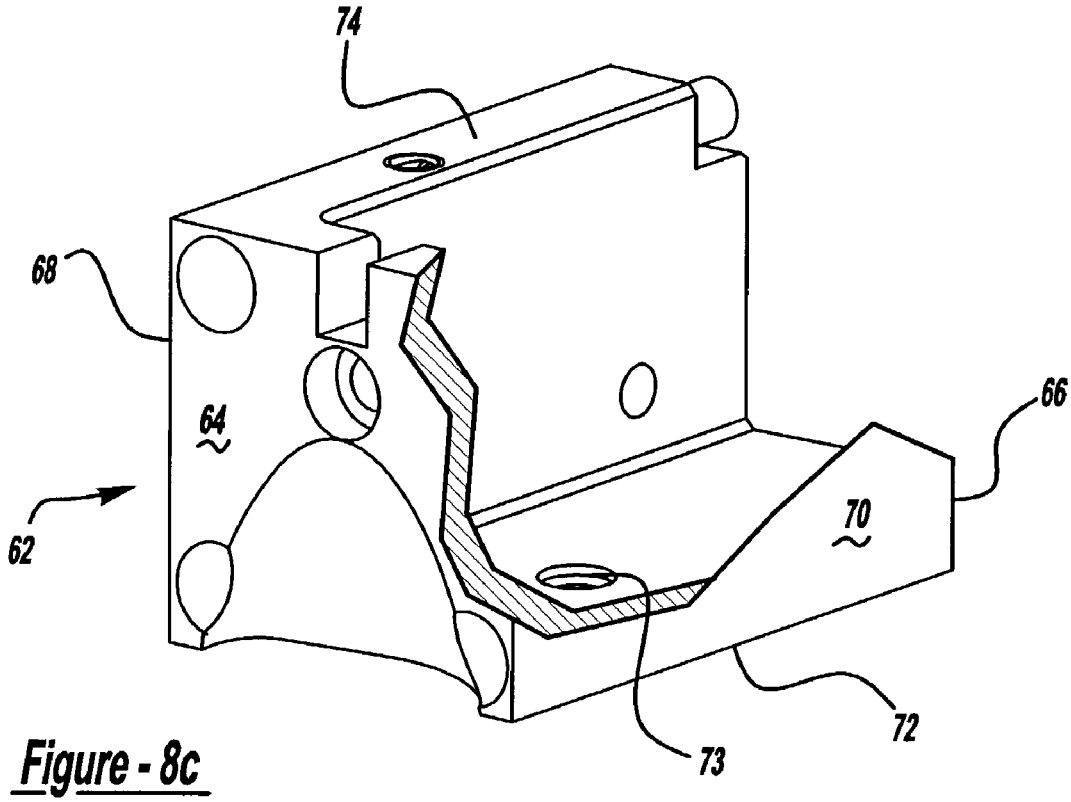
FIG. 8*c* is an isometric view of a housing of the pneumatic work support actuator shown in FIG. 8*a;*

Again for purposes of clarity, only the composition and operation of the first pneumatic work support actuator 60 will be disclosed, however it should be appreciated that the pad forming device 10 includes a second identical pneumatic work support actuator 60' configured to actuate the second work support device 42'. As shown in FIGS. 8*a*–8*c*, the pneumatic work support actuator 60 implements a toggle lock device 94 adapted to actuate the internal locking mechanism (not shown) of a work support thereby locking the plunger 44 in place, and thereafter mechanically resisting an opposing force externally applied to the plunger 44, whereby the pneumatic work support actuator 60 is capable of resisting forces of substantially greater magnitude than heretofore possible with conventional pneumatic devices.

The pneumatic work support actuator 60 includes a housing 62 having an inlet end 64 and an open outlet end 66. The open outlet end 66 of the housing 62 is attached to the work support cylinder 48 in a conventional manner, such as the cap screws shown in FIG. 8*a*. Brackets 76, 78 are similarly attached to opposing sides 68, 70 of the housing 62 near the inlet end 64 thereof, and extend in a direction away from the inlet end 64 of the housing 62. A pneumatic cylinder 80 of a known type, i.e. Bimba model number FM-1740-2FMT, is pivotally disposed between and attached to the brackets 76, 78 near the inlet end 64 of the housing 62. The pneumatic cylinder 80 includes a body portion 82, a piston rod 84 that is extendable and retractable in response to pneumatic pressure, and a coupling member 86 attached to the exposed end of the piston rod 84. A fixed spacer block 88 having a generally planar face 90 and an opposite face with a channel section 92 therein is disposed within and attached to the housing 62 such that the planar face 90 is mounted to an internal portion of the inlet end 64 with a cap screw and the channel section 92 runs between opposing sides 68, 70 of the housing 62.

The toggle lock portion 94 of the pneumatic work support actuator 60 is disposed within the housing 62 and preferably includes a first link member 96, and a second link member 104. The link members 96, 104 are generally rectangular with complementary radial end portions. The first link member 96 includes a convex end 98 pivotally engaged in the channel section 92 of the fixed spacer block 88, an opposite concave end 100 adapted to accommodate the second link member 104, and an integral lever arm 102 pivotally attached to the coupling member 86 of the pneumatic cylinder 80. The second link member 104 includes opposing convex ends 106, 108 adapted to pivotally engage the first link member 96 and a piston engagement member 110, respectively. The piston engagement member 110 includes a surface having a channel section 112 adapted to accommodate the second link member 104 and an opposite planar surface 114 adapted to engage the movable piston (not shown) of the work support device 42. A support pin 116 is inserted through a hole 73 in a bottom portion 72 of the housing 62 such that a pointed engagement end 118 of the support pin 116 supports the toggle lock device 94 to prevent over-travel thereof. A spacer element 122 disposed between a head portion 120 of the support pin 116 and the bottom portion 72 of the housing 62 is preferably ground to a width that precisely limits insertion of the pointed engagement end 118 of the support pin 116 such that the link members 96, 104 are within ±0.3° of co-planar alignment when the toggle lock device 94 is supported thereby. A top plate 124 attached to an otherwise open top portion 74 of the housing 62, preferably with cap screws, retains the link members 96, 104 within the housing 62 and further prevents over-travel of the toggle lock device 94.

Figure 11:
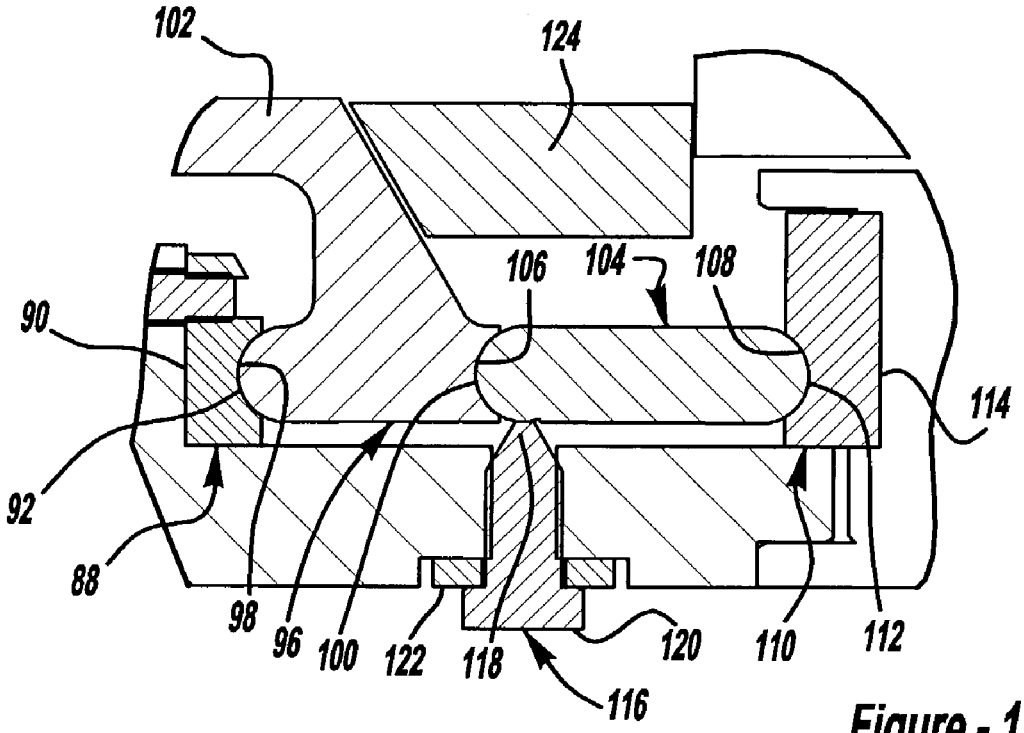
FIG. 11 is a section taken along line 11—11 of FIG. 10, showing the toggle lock device of FIG. 8*b* in the locked position.
Figure 12:
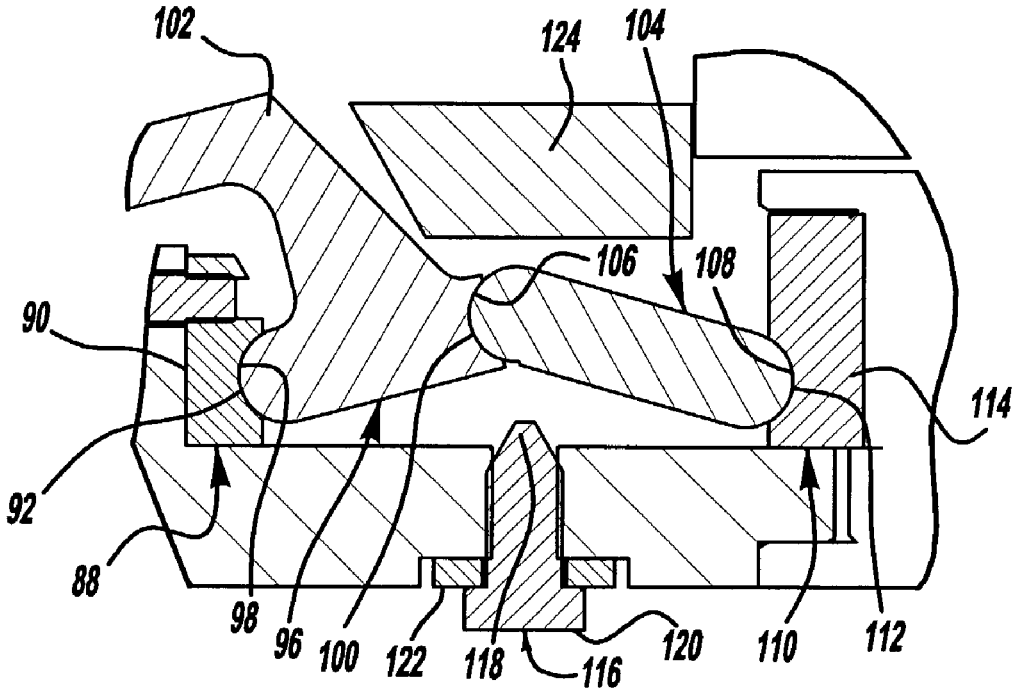
FIG. 12 is a section taken along line 11—11 of FIG. 10, showing the toggle lock device of FIG. 8*b* in the unlocked position.

Extension of the pneumatic cylinder piston rod 84, and the lever arm 102 indirectly attached thereto, applies a moment of inertia about the first link member's convex end 98 that is pivotally engaged in the channel section 92 of the fixed spacer block 88, tending to align the link members 96, 104 and thereby engage the toggle lock device 94. Conversely, retraction of the piston rod 84 applies an opposite moment of inertia tending take the link members 96, 104 out of alignment thereby disengaging the toggle lock device 94. FIGS. 11 and 12 respectively show the locked and unlocked positions of the toggle lock device 94.

Referring again to FIGS. 8*a*–8*c*, when the pneumatic cylinder piston rod 84 is extended, the corresponding alignment of the link members 96, 104 has the effect of advancing the piston engagement member 110 into the cylinder 48 of the work support device 42 such that a force is applied to the movable piston (not shown), the internal sleeve (not shown) of the work support device 42 is contracted and the work support plunger 44 is locked. When the toggle lock device 94 is engaged, it can mechanically resist substantial force applied along the axis of alignment thereof, as is the case with an external force applied to the work support plunger 44 in that any such force is translated through the movable piston (not shown) and to the toggle lock device 94 along its axis of alignment. In this manner, the pneumatic work support actuator 60 is capable of maintaining the work support device 42 in the locked condition under much greater loads than heretofore possible with devices relying exclusively on pneumatic pressure.

Referring again to FIG. 6*d*, after the pad forming device 10 has "found" the work piece WP as described hereinabove, the portion of the work piece WP radially within the support surface 30 of the face plate 26 is deformed outwardly until it makes contact with the pad contacting surface 40 of the fixed anvil 36. As best seen in FIGS. 2–5, this deforming is accomplished under a load that is imposed by the forming die 126, that is attached to a die block 130. The die block 130 is reciprocated between the broken line position and the solid line position shown in FIG. 4 by a form ram 132 driven by a ball screw device 134 described in detail hereinafter.

As best seen in FIG. 4, a reversible electric servo-motor 140 is mounted to the back of the motor plate 12 in alignment with the aperture 12*a* to drivingly engage the ball screw device 134 which is adapted to convert the rotation of the servo-motor 140 into translatory motion. The ball screw device 134 includes a screw member 136, a nut member 138 threaded thereon, and a plurality of balls therebetween (not shown). The ball screw device 134 is disposed generally parallel with and between the first and second side plates 14, 16, extends in a first direction through the aperture 12*a* of the motor plate 12 to engage the servo-motor 140, and extends in the opposite direction into engagement with the form ram 132. The nut member 138 is disposed within and attached to a hollow engagement portion 132*a* of the form ram 132, and is translated along the length of the screw member 136, in a fore/aft direction, in response to the servo-motor 140. Actuation of the servo-motor 140 is controlled by a programmable control device (not shown) that is generally well known and may take the form of any suitable programmable microprocessor.

A linear transducer (not shown) operatively connected to the form ram 132 generates position feedback signals used by the programmable control device to achieve a desired position and motion for the forming die 126. Accordingly, the servo-motor 140 is operated by program controls to drive the form ram 132 through various stroking modes, in which ram position, velocity, and acceleration may be programmed to vary over the course of a stroke and simultaneously monitored. The more sophisticated programmable forming motion disclosed hereinabove adds flexibility such that a single pad forming device 10 is able to accommodate a variety of different applications. For example, a single pad forming device 10 may form a first attachment pad P in a relatively thin portion of the work piece WP using a slower stroke speed, and thereafter form a second attachment pad P in a relatively thicker portion of the work piece WP using a faster stroke speed. As another example, the cycle time can be reduced by varying the speed of the form ram 132 over the forming cycle with a rapid ram advance and retraction combined with slow speed during the actual forming and/or piercing.

After an attachment pad P (shown in FIG. 7) has been formed in the manner described hereinabove, and before the form ram 132 is extended to retract the forming die 126 from the work piece WP, it is frequently desirable to form an aperture in the raised attachment pad P by lancing an opening, punching a slug, or by piercing, to provide an attachment aperture such as hole H (shown in FIG. 7) adapted to facilitate the subsequent attachment of an outer body panel. The lancing, punching, or piercing of the raised attachment pads P may be done most conveniently by the pad forming device 10, before it is withdrawn from the work piece WP. For this purpose a second ball screw device 134' is provided to drive the punch 34 in a manner similar to that in which the forming die 126 is driven by the ball screw device 134. A second reversible electric servo-motor 140' is mounted to the back of the motor plate 12 in alignment with the aperture 12*b* to drivingly engage the second ball screw device 134'. The second ball screw device 134' is disposed generally parallel with and between the first and second side plates 14, 16, extends in a first direction through the aperture 12*b* of the motor plate 12 to engage the second servo-motor 140', and extends in an opposite direction into engagement with a punch ram 142. A nut member 138' of the second ball screw device 134' is disposed within and attached to a hollow engagement portion 142*a* of the punch ram 142, and is translated along the length of a screw member 136', in a fore/aft direction, in response to the servo-motor 140'. A carriage 146 is mounted to the punch ram 142 and extends therefrom in an upward direction. A back up 148 is mounted to the carriage 146 such that the punch 34 is removably secured therebetween. Accordingly, as shown in FIG. 6*e*, actuation of the second servo-motor 140' drives the punch 34 through the portion of the raised attachment pad P that is radially within and therefore unsupported by the forming die 126, and into the hollow central portion 128 thereof to punch the hole H (shown in FIG. 7).

A second linear transducer (not shown) operatively connected to the punch ram 142 generates position feedback signals used by the programmable control device to achieve a desired position and motion for the punch 34. The second servo-motor 140' is operated by program controls to drive the punch ram 142 through various stroking modes, in which punch position, velocity, and acceleration may be programmed to vary over the course of a single stroke. As the stroke length of the punch 34 is variable, a single pad forming device 10 may be configured to punch a variety of hole sizes and/or shapes for different applications. For this purpose, as shown in FIG. 5, the punch 34 includes a primary cutting surface 34*a* at an end portion thereof, and a secondary cutting surface 34*b* located a predetermined axial distance therefrom. In one example, the primary cutting surface 34*a* defines a circle and the secondary cutting surface 34*b* defines an oval that radially encompasses the circle defined by the primary cutting surface 34*a*. A round hole can be formed by limiting the punch 34 stroke length such that only the primary cutting surface 34*a* engages the work piece WP, whereas extending the stroke length such that both the initial and second cutting surfaces 34*a*, 34*b* pass through the work piece WP provides an elongated slot.

Additionally, the second linear transducer (not shown) can be configured to provide an electrical current signature for the punch 34, which, as is well known in the art, can be used for error proofing the punching process. Punch resistance during engagement with the work piece WP generates a current spike indicative of a successful operation, and conversely, the absence of a current spike indicates the desired operation was not properly performed (i.e. the punch broke and did not engage the work piece WP). Therefore, the pad forming device 10 can be programmed to automatically shut down and alert an operator the first time the punching operation is unsuccessful, and any related problems can be immediately addressed.

While the preferred embodiment of the invention has been disclosed, it will be apparent to those skilled in the art that changes may be made to the invention as set forth in the claims and, in some instances, certain features of the invention may be used to advantage without corresponding use of other features. Accordingly, it is intended that the illustrative and descriptive materials herein be used to illustrate the principles of the invention and not to limit the scope thereof. While the form of the embodiment of the invention herein disclosed constitutes a preferred form, it is to be understood that other forms might be adopted as may come within the scope of the claims which follow.

What is claimed is:

1. A programmable apparatus for reforming a first body member to establish a surface precisely located at a predefined net reference position and adapted for attachment to a second body member, said programmable apparatus comprising:

an anvil;

programmable means for selective movement of said anvil to said predefined net reference position with respect to said first body member;

means for engaging said first body member;

means for locking and maintaining said means for engaging into engagement with said first body member;

a movable form ram aligned with said anvil, said movable form ram having a pad forming die attached thereto; and drive means for converting rotary motion into translatory motion, said drive means connected to said form ram to effect translation thereof whereby said translation of said form ram reforms said first body member between said pad forming die and said anvil to create a surface precisely located at said predefined net reference position.

2. A programmable apparatus according to claim 1 further comprising means for programmably actuating said form ram, said programmable actuating means comprising:

a reversible servo-motor engaged with said drive means for converting rotary motion into translatory motion;

means for programming stroke length of said drive means for converting rotary motion into translatory motion; and means for programming form ram velocity and acceleration to vary over the course of said stroke.

3. A programmable apparatus according to claim 1, wherein said means for locking and maintaining comprises a work support having an internal locking mechanism; and means for pneumatically actuating and maintaining said internal locking mechanism of said work support.

4. A programmable apparatus according to claim 1, wherein said anvil comprises a hollow portion and a pad contacting surface, further wherein said pad forming die has a hollow central portion.

5. A programmable apparatus according to claim 4, wherein said means for engaging said first body member comprises:

a face plate having a passage therethrough and a support surface, said support surface being adapted to engage said first body member; and means for retractably biasing said face plate in a fully extended position relative to said anvil, whereby engagement with said first body member is adapted to overcome said fully extended bias and retract said support surface of said face plate by an amount necessary to align said pad contacting surface with said predefined net reference position.

6. A programmable apparatus according to claim 5 further comprising:

piercing means for making a hole through said reformed portion of said first member, said piercing means being disposed within said hollow portion of said anvil; and means for programmably translating said piercing means through said reformed portion of said first member and into said hollow central portion of said pad forming die to make said hole.

7. A programmable apparatus according to claim 6, wherein means for programmably translating said piercing means includes means for automatically recognizing when said piercing means fails to form said hole.

8. A programmable apparatus according to claim 6, wherein said means for programmably translating said piercing means comprises a servo driven ball screw device including means for setting the length of a stroke, said servo driven ball screw device further including means for programming velocity and acceleration of said pierce means to vary over the course of said stroke.

9. A programmable apparatus according to claim 8, wherein said piercing means comprises a punch, said punch terminating at one end in a primary cutting surface, said punch having a secondary cutting surface spaced a predetermined axial distance from said primary cutting surface, said punch being adapted to provide a hole having a first contour by limiting said stroke length such that only said primary cutting surface engages said first body member, said punch further being adapted to provide a hole having a second contour by increasing said stroke length such that both primary and secondary cutting surfaces engage said first body member.

10. An apparatus for reforming a first body member to establish a surface precisely located at a predefined net reference position and adapted for attachment to a second body member, said apparatus comprising:

a fixed anvil having a hollow portion and a pad contacting surface;

means for programmably moving said fixed anvil, said programmable moving means being adapted to position said fixed anvil at said predefined net reference position;

a face plate having a support surface adapted to engage said first body member, said face plate further having a passage through which said fixed anvil is disposed;

means for retractably biasing said face plate in a fully extended position relative to said fixed anvil, whereby engagement with said first body member is adapted to overcome said fully extended bias and retract said support surface of said face plate by an amount necessary to position said pad contacting surface at said predefined net reference position, means for pneumatically locking and maintaining said face plate in said retracted position such that said support surface remains in contact with said external surface of said first body member;

a form ram aligned with said anvil, said movable form ram having a forming die attached thereto, said forming die having a hollow central portion therethrough;

means for programmably translating said form ram to advance said forming die toward said fixed anvil and thereby reform said first body member between said forming die and said fixed anvil such that said external surface of the reformed portion of said first member is precisely located at said predefined net reference position.

11. An apparatus according to claim 10, wherein said means for pneumatically locking and maintaining said face plate comprises a work support having an internal locking mechanism and a pneumatic work support actuator adapted to engage and maintain said internal locking mechanism of said work support.

12. An apparatus according to claim 10 further comprising:

a cutting tool for making an opening through said reformed portion of said first body member, said cutting tool being disposed within said hollow portion of said fixed anvil; and means for programmably translating said cutting tool through said reformed portion of said first body member and into said hollow central portion of said forming die to make said hole.

13. An apparatus according to claim 12, wherein means for programmably translating said cutting tool includes means for automatically recognizing when said cutting tool fails to form said hole.

14. An apparatus according to claim 12, wherein said means for programmably translating said form ram and said means for programmably translating said cutting tool each comprise a servo driven ball screw device, each said servo driven ball screw device comprising means for setting stroke length; and means for programming velocity and acceleration to vary over the course of said stroke.

15. An apparatus according to claim 14, wherein said means for programming velocity and acceleration to vary over the course of said stroke includes means for programming rapid advance and retraction combined with slow speed during actual processing whereby overall cycle time is reduced.

16. An apparatus according to claim 14, wherein said cutting tool comprises a punch, said punch terminating at one end in a primary cutting surface, said punch having a secondary cutting surface spaced a predetermined axial distance from said primary cutting surface, said punch being adapted to provide said opening having a first contour by limiting said stroke length such that only said primary cutting surface engages said first body member, said punch further being adapted to provide an opening having a second contour by increasing said stroke length such that both primary and secondary cutting surfaces engage said first body member.

17. A cutting tool adapted for cutting a workpiece, said cutting tool comprising:

an elongated body member having a first end portion and a second end portion opposite said first end portion;

a first cutting surface having a first peripheral shape and first peripheral size formed at said first end portion of said cutting tool;

at least one additional cutting surface having a second peripheral shape and second peripheral size disposed a predetermined axial distance from said first cutting surface; and drive means for converting rotary motion having an axis of rotation into translatory motion, along said axis of rotation said drive means connected to said elongated body member to effect translation thereof along said axis of rotation such that translation of said elongated body member to a first predetermined position selectively provides said workpiece with one of said first peripheral shape and first peripheral size defined by said first cutting surface and whereby further translation of said elongated body member along said axis of rotation to a second predetermined position redefines said first opening to a second opening with the other of said first peripheral shape and first peripheral size defined by said second cutting surface on said elongated body member.

18. An apparatus for mechanically actuating and maintaining engagement of an internal locking mechanism of a work support, said apparatus comprising:

a housing having an inlet end and an outlet end opposite said inlet end, said outlet end of said housing being attached to said work support;

a piston engagement member disposed within said outlet end of said housing;

a toggle lock device having a plurality of pivotally engaged link members disposed within said housing, said toggle lock device adapted to advance said piston engagement member into engagement with said work support to actuate said internal locking mechanism, said toggle lock device further adapted to disengage said piston engagement member from said work support to release said internal locking mechanism; and a pneumatic piston for selectively actuating said mechanical locking and unlocking means mounted to said inlet of said housing whereby said internal locking mechanism of said work support is selectively locked and released.

19. An apparatus according to claim 18, wherein at least one of said plurality of pivotally engaged link members comprises a lever arm extending therefrom, said lever arm terminating in an end portion attached to said pneumatic piston whereby translation of said lever arm in a first direction applies a moment of inertia tending to align said link members thereby locking said toggle lock device, and translation of said lever arm in a second direction applies a moment of inertia tending to misalign said link members thereby unlocking said toggle lock device.

20. An apparatus according to claim 19, wherein said housing further comprises an open top portion and a bottom portion opposite said open top portion, said bottom portion having a hole therethrough.

21. An apparatus according to claim 20 further comprising a support pin inserted through said hole in said bottom portion of said housing, said support pin being adapted to support said plurality of link members and prevent over-travel thereof.

22. An apparatus according to claim 21 further comprising a top plate mounted to said open top portion of said housing, said top plate being adapted to retain said plurality of link members and prevent over-travel thereof.

23. A method of reforming a surface of a first member to establish a precise location of said surface at a predefined net reference position adapted for attachment to a second member, said method comprising the steps of:

providing a net locating apparatus having a fixed anvil;

moving said net locating apparatus into engagement with said first member such that said fixed anvil is aligned with said predefined net reference position;

locating said first member relative to said predefined net reference position;

locking said first member relative to said predefined net reference in position;

providing a form ram aligned with said anvil, said form ram having a forming die attached thereto; and programmably translating said form ram to advance said forming die toward said fixed anvil and thereby reform said first member between said forming die and said fixed anvil such that said surface of the reformed portion of said first member is precisely located at said predefined net reference position.

24. The method according to claim 23 further comprising the step of providing a cutting tool comprising:

an elongated body member having a first end portion and a second end portion opposite said first end portion;

a first cutting surface formed at said first end portion of said cutting tool; and at least one additional cutting surface disposed a predetermined axial distance from said first cutting surface.

25. The method according to claim 24 further comprising the step of programmably translating said cutting tool such that said first member is selectively provided with a first opening defined by said first cutting surface and thereafter further translating of said cutting tool along its axis to redefine said first opening into a second opening defined by said at least one additional cutting surface.

26. The method according to claim 25, wherein said step of programmably translating said cutting tool further comprises the step of providing a device for automatically recognizing when said cutting tool fails to form said first opening.

27. The method according to claim 25, wherein said steps of programmably translating said form ram and programmably translating said cutting tool each further comprise the step of increasing translation velocity during predetermined intervals for each cycle such that the overall cycle time is reduced.

* * * * *

UNITED STATES PATENT AND TRADEMARK OFFICE

CERTIFICATE OF CORRECTION

PATENT NO. : 7,117,706 B2
APPLICATION NO. : 10/329893
DATED : October 10, 2006
INVENTOR(S) : Mark A. Savoy It is certified that error appears in the above-identified patent and that said Letters Patent is hereby corrected as shown below:

In Column 8, Line 61, kindly delete “servomotors” and insert --servo-motors--.

In Column 9, Line 7, kindly delete “16b” and insert --16b,--.

In Column 12, Line 61, after “tending” kindly insert --to--.

In Column 16, Line 57, kindly delete “,” and insert --;--.

In Column 16, Line 64, kindly delete “;” and insert --; and--.

Signed and Sealed this

Sixth Day of February, 2007

JON W. DUDAS
*Director of the United States Patent and Trademark Office*